US006516645B2

(12) United States Patent
Morales et al.

(10) Patent No.: US 6,516,645 B2
(45) Date of Patent: Feb. 11, 2003

(54) HOT DIE CLEANING FOR SUPERPLASTIC AND QUICK PLASTIC FORMING

(75) Inventors: Arianna T. Morales, Royal Oak, MI (US); Edward Frank Ryntz, Warren, MI (US); Nelson T. Brinas, Sterling Heights, MI (US)

(73) Assignee: General Motors Corporation, Detroit, MI (US)

( * ) Notice: Subject to any disclaimer, the term of this patent is extended or adjusted under 35 U.S.C. 154(b) by 180 days.

(21) Appl. No.: 09/748,096

(22) Filed: Dec. 27, 2000

(65) Prior Publication Data

US 2002/0078727 A1 Jun. 27, 2002

(51) Int. Cl.[7] ..... B24B 11/00; C21D 7/06

(52) U.S. Cl. ..... 72/53; 72/40; 72/60; 451/39; 29/90.7

(58) Field of Search ..... 72/53, 57, 60, 72/40; 451/38, 39; 29/90.7

(56) References Cited

U.S. PATENT DOCUMENTS 3,485,073 A * 12/1969 Burney ..... 72/53
4,038,786 A 8/1977 Fong ..... 51/320
4,389,820 A 6/1983 Fong et al. ..... 51/410
4,581,913 A * 4/1986 Reed ..... 72/53
5,373,047 A * 12/1994 Schnelle et al. ..... 451/39
5,409,415 A * 4/1995 Kawanami et al. ..... 451/39
5,671,628 A * 9/1997 Halila et al. ..... 72/53
5,819,572 A 10/1998 Krajewski ..... 72/42
5,974,847 A 11/1999 Saunders et al. ..... 72/57
6,416,389 B1 * 7/2002 Perry et al. ..... 451/39

* cited by examiner

*Primary Examiner*—David Jones
(74) *Attorney, Agent, or Firm*—Kathryn A. Marra

(57) ABSTRACT

Equipment and methods for the rapid and easy cleaning of metal forming dies while in a press and operating at elevated temperatures. The invention features the physical removal of excess lubricant collecting on the hot surface of the forming dies under operating conditions so that no lubricant-induced flaws occur on the show surface of the formed part for optimized production of high quality parts. Special and effector tooling is supplied with high velocity air which draws in solid $CO_2$ which sublimes into pressurize streams of gaseous $CO_2$ that is discharged through nozzles onto the forming surfaces of hot forming dies after a number of lubricated parts have been formed therewith to physically sweep foreign matter including lubricants from the die surfaces. A robot is employed to move the activated end effector in predetermined paths across the dies for fully sweeping and cleaning the forming surfaces. The gas then dissipates.

4 Claims, 4 Drawing Sheets

HOT DIE CLEANING FOR SUPERPLASTIC AND QUICK PLASTIC FORMING

TECHNICAL FIELD

This invention relates to the art of cleaning hot forming dies and, more particularly, to new and improved processes for the rapid and contaminate-free cleaning of lubricants and other foreign matter from hot working surfaces of superplastic and quick plastic forming dies to enhance the production of formed sheet metal parts with high quality show surfaces.

BACKGROUND OF THE INVENTION

Prior to the present invention, various processes and types of equipment have been developed to form sheets of alloys of aluminum and other suitable metallic materials into panels or other parts for vehicles or other constructions. Among such process and equipment are super and quick plastic forming processes and equipment in which a ductile metal sheet of suitable metallic material is heated and stretched onto the forming surfaces of a hot die to improve production of high quality parts. Examples of such processes and equipment are found in U.S. Pat. No. 5,974,847 issued Nov. 2, 1999 to Saunders et al. for Superplastic Forming Process, and U.S. Pat. No. 5,819,572 issued Oct. 13, 1998 to P. E Krajewski for Lubricating System For Hot Forming, both assigned to the assignee of this invention and both hereby incorporated by reference.

While such hot plastic forming processes and equipment provide improved parts, production efficiency has at times been diminished because of rejection of some parts for indentations and other irregularities occurring in the show surfaces thereof. Such surface imperfections are primarily caused by the accumulation of foreign matter and particularly dry lubricants used on the blank sheets of material on the hot die during the hot superplastic forming processes. Such matter accumulating on the precision forming surface of the hot die deforms the hot outer surfaces of the part being formed under the loads of the superplastic or quick plastic processes.

SUMMARY OF THE INVENTION

In contrast to the prior art, the present invention provides new and improved methods and mechanisms that meets higher standards for cleaning hot superplastic and quick plastic forming dies while in the press and operating at elevated temperatures. More particularly, the invention is directed to the effective removal of accumulated foreign matter and particularly dry lubricants so that such foreign matter does not effect the formation of flaws such as lubrication marks in the outer surfaces or tears in the bends of the parts formed by the die.

This invention provides new and improved $CO_2$ hot die cleaning methods with the controlled discharge of dry ice which at least partially sublimes and impinges on the surface of a heated forming die to contact and displace foreign matter from the surface of the forming die so that the forming die can be quickly operated to again produce parts with Class A part surface quality. This invention eliminates lubricant and oxide build-up on the die surfaces and provides a significant improvement in the efficient and quantity production of Class A quality surfaces on metallic parts and panels formed by the dies. Importantly, there is no liquid residue or other consequential pollution produced by this process. The cleaning procedure for dry cleaning forming dies reduces cleaning frequency with minimized $CO_2$ consumption to provide improved operating efficiency.

This invention further provides a new and improved hot die cleaning unit comprising a special end effector for discharging streams of $CO_2$ gas and solid mixed into streams of pressurized air onto the hot surface of the die operatively mounted in a press when the press is open. The unit features the quick attachment and release of the end effector to a programmed robot operable to move the discharge end of the end effector across the die in a controlled pattern and at a predetermined distance from the forming surface with optimized discharge of the carbon dioxide and air cleaning mixture to decrease the cycle time required to complete effective cleaning of hot die surfaces during the production cycling of such dies.

BRIEF DESCRIPTION OF THE DRAWINGS

These and other features, objects and advantages will become more apparent from the following detailed description and drawings in which.

DESCRIPTION OF THE PREFERRED EMBODIMENT

Figures 1, 1A:
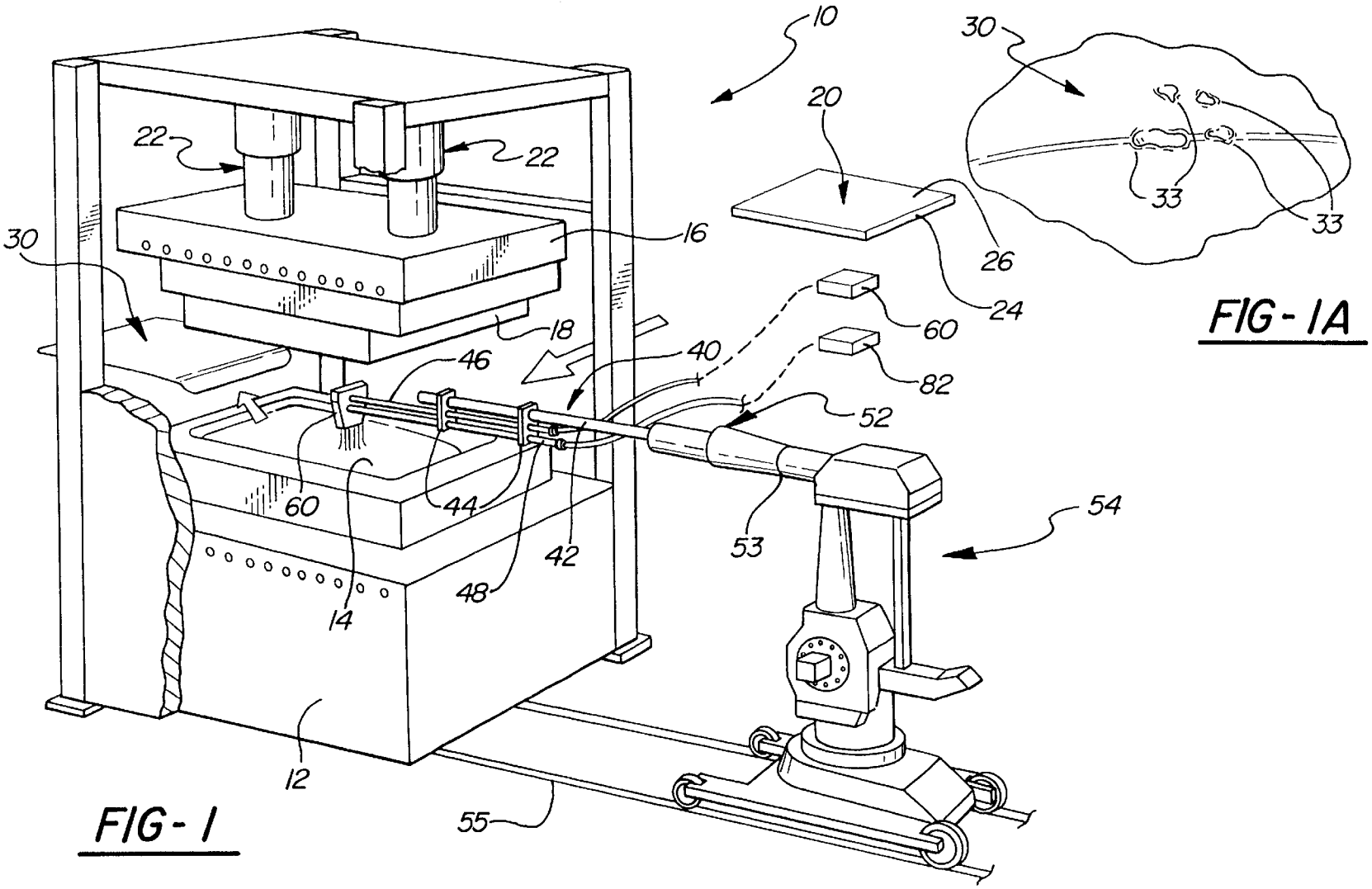
FIG. 1 is a pictorial view of an opened forming press with forming dies to be cleaned by cleaning equipment according to this invention.

Turning now in greater detail to the drawings, FIG. 1 illustrates a forming press 10 comprising a lower bolster plate 12 on which lower steel forming die 14 is mounted in addition to a reciprocating ram plate 16, which carries an upper tool chamber 18 which basically corresponds to the upper tool of the above-referenced U.S. Pat. No. 5,819,572. Both of the plates 12 and 16 are electrically heated to establish the required heat energy levels in the die and the sheet metal blanks 20 for superplastic forming or quick plastic forming as is known in this art. Moreover, the die steel 14 can be mounted on the upper plate instead of the lower plate and the chamber 18 operatively supported on the lower plate if desired and depending on the characteristics of the part to be made.

The ram plate 16 is moved by hydraulic cylinders 22 to cycle the ram plate from the open position for blank loading to the closed blank forming position and then back to the open shown in FIG. 1 for formed part removal. The blanks 20 utilized with one preferred embodiment of this invention are flattened sheets 24 of aluminum alloy coated with a dry lubricant 26 such as boron nitride to function as a release agent to prevent the formed panel 30 from sticking to the die and furthermore to enhance the stretching and formation of the part during forming operation. As the parts are being serially formed in the press, quantities of dry lubricant 26 as well as other foreign matter may accumulate on the forming surfaces of the die. This material is diagrammatically illustrated as collected matter 32 in FIG. 6.

Because of the progressive accumulation of lubricants on the forming surfaces, panels 30 subsequently formed by the dies will likely have surface flaws or imperfections in the form of dimples, streaks, or other blemishes formed thereon. These flaws are diagrammatically illustrated as visible imperfections 33 in FIG. 1A. Such flaws are generally found by visible inspection and the part scrapped and recycled. In any event, when the part is subsequently cleaned in a wash line, the visibility of such deformities is exacerbated and the part will fail inspection and have to be scrapped.

To eliminate accumulations of lubricant on the die surfaces, the present invention provides a new and improved cleaning tool or end effector 40 comprising a rigid and elongated tubular support 42 having spaced support brackets 44 extending transversely from fixed points therealong. The support brackets fasten to a cylindrical air conducting tube 46 disposed in general parallel relationship with respect to the support tube 42. A second elongated tube 48 for conducting generally cylindrical pellets 50 of $CO_2$ (dry ice) is also supported by these brackets or by additional support brackets 51 (FIG. 2) extending transversely from fixed points along the air conducting tube 46 to mount pellet conducting tube 48 in general parallel relationship to the rigid support and air tubes.

The support tube 42 of the end effector 40 is provided with a conventional quick release coupling 52 at the inboard end thereof for selective operative connection with an arm 53 of a programmed robot 54 which is capable of moving to any position along rails 55 supported by the floor. After moving from an out-of-way station to a predetermined position adjacent to the press in a die cleaning operation, the robot arm activates to move the end effector 40 into an operative cleaning position relative to the forming die. More particularly, the discharge end or cleaning head 62 at the free end of the end effector is pointed to and is located at a given height above the forming surfaces of the die and in the limited space between the lower steel forming die and the upper tool chamber supported in the opened press.

The end effector with its cleaning head operating is then longitudinally and laterally moved in a predetermined sweeping pattern and at a predetermined and variable distance with respect to the varying contours of the forming die. This movement is in accordance with the programmed robot to effect the dry cleaning of the hot die with the ejected streams of $CO_2$ and air as will be further explained hereinafter. Moreover, the robot can turn the end effector and the cleaning head to any angular position about the horizontal axis A of the support tube so that any tooling supported by the plates of the press can be readily cleaned as needed. After such cleaning, the robot withdraws the end effector from the die and out of the press. The robot then takes the end effector to a storage station and releases it from the arm 53 by operation of the quick release coupling 52 so that it is available for further duties.

The air tube 46 has a connector 56 at its inboard end for releasable connection with a flexible air supply hose 58 leading from a pressurized and controlled air supply source 60 to the cleaning head 62 fixed to the outboard end of the air tube. As shown, the head 62 extends at a given angle such as 90 degrees with respect to the air and pellet conducting tubes 46 and 48 to afford improved support and improved aiming of the cleaning head 62 with respect to the forming surfaces of the forming die for augmenting the cleaning of the forming die.

Figure 4:
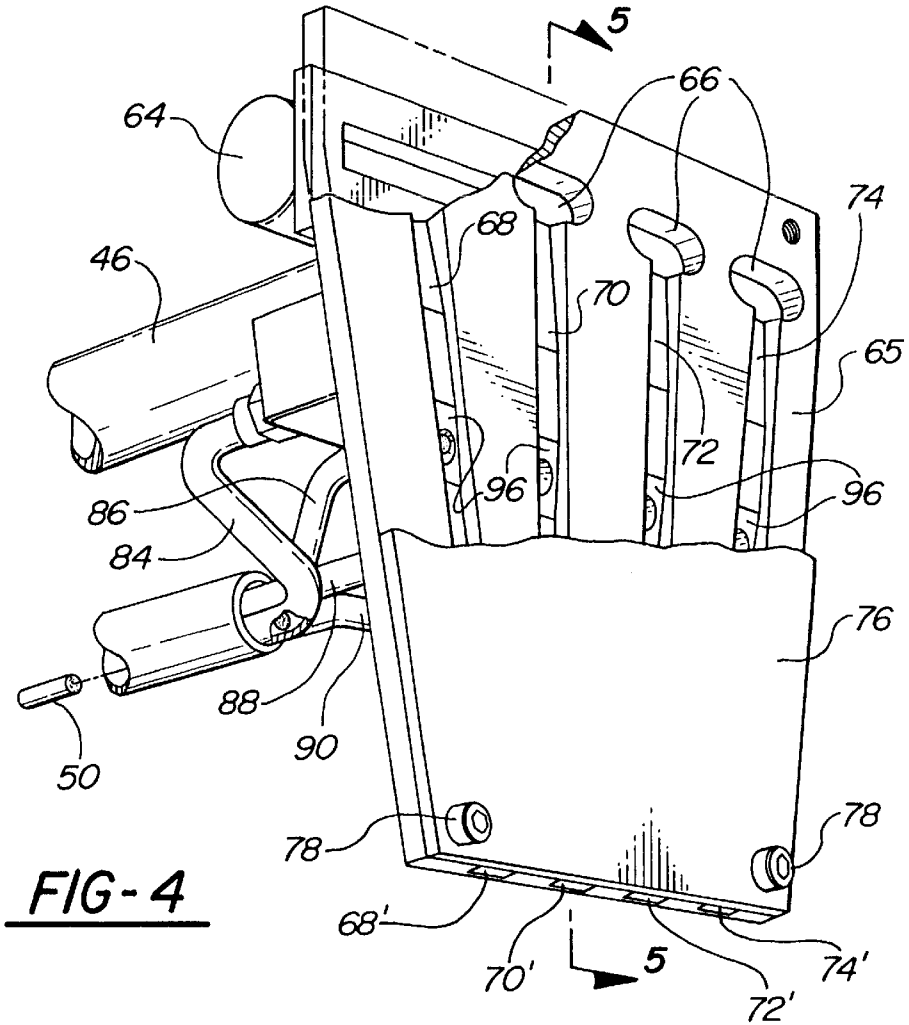
FIG. 4 is a pictorial view of the head portion, partly broken away, of the cleaning unit of FIGS. 1 and 2.
Figure 3:
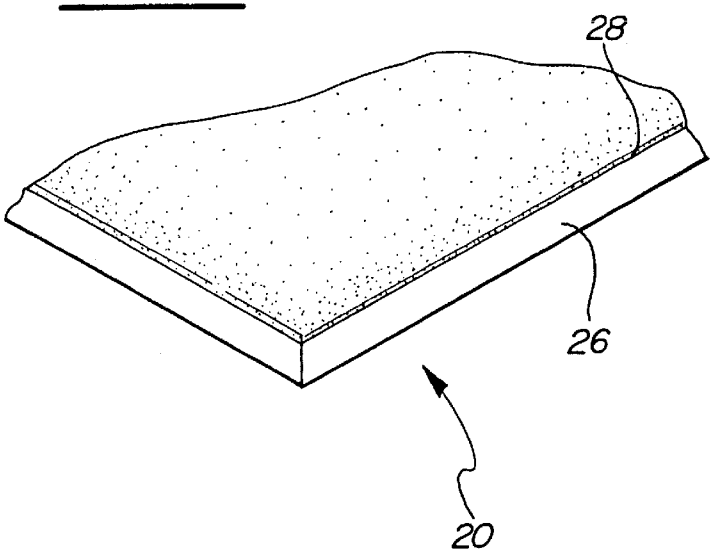
FIG. 3 is a pictorial view of a portion of a blank sheet of metallic material to be formed by the die set of FIGS. 1 and 2.
Figure 6:
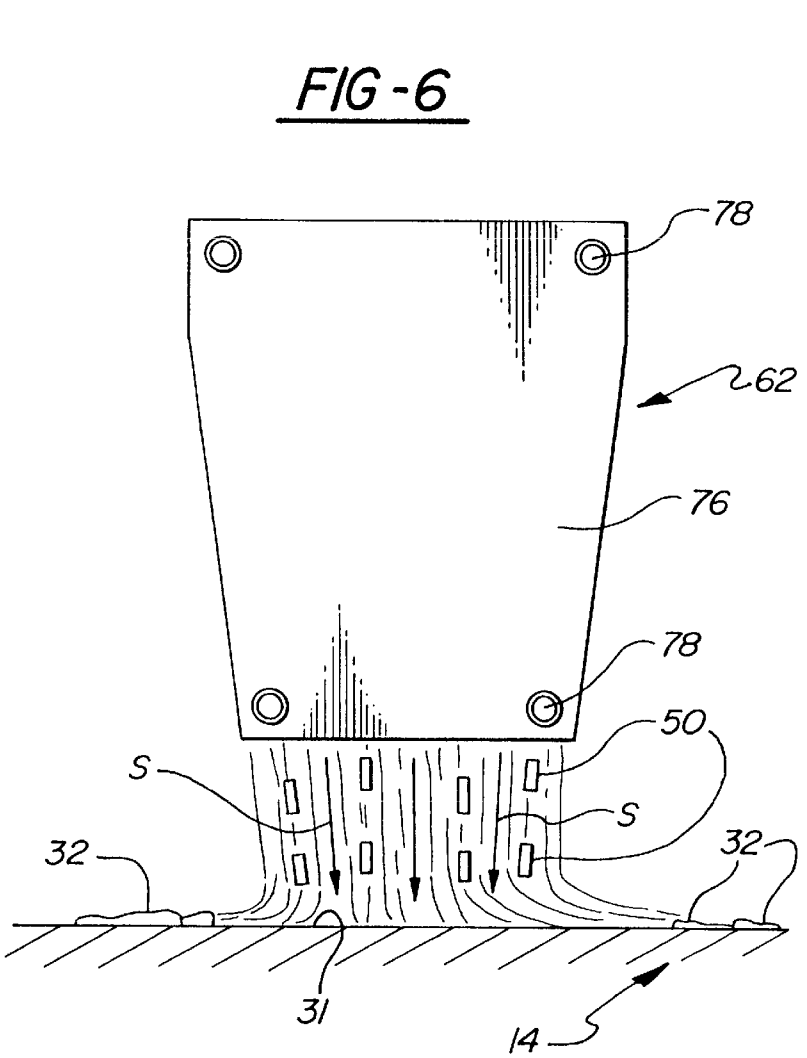
FIG. 6 is an end view of the head of the cleaning unit of FIGS. 1, 2, 4 and 5.
Figure 5:
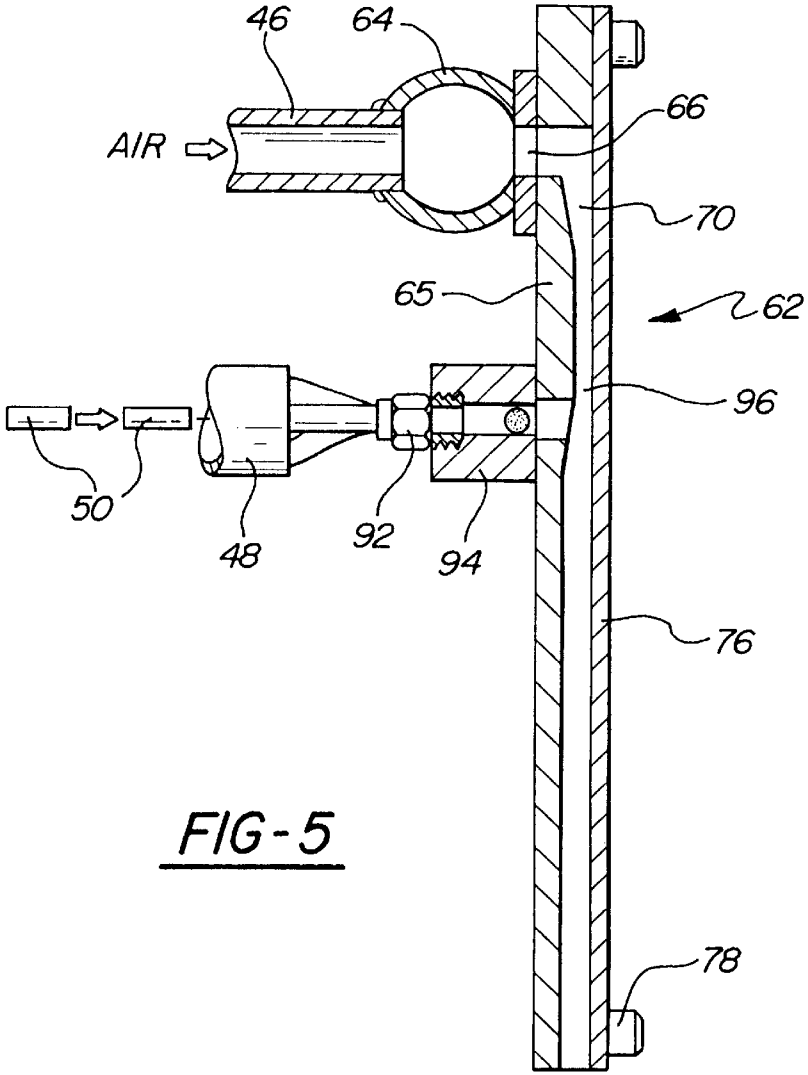
FIG. 5 is a cross-sectional view taken generally along sight lines 5—5 of FIG. 4.

More details of the cleaning head 62 are shown in FIGS. 4, 5 and 6 in which the outboard end of the air conducting tube 46 is rigidly secured to a transversely extending manifold 64, in turn fastly secured to the inner side of a thick and flattened base plate 65 of the head 62. The manifold pneumatically connects to and feeds high velocity streams of air into the four laterally-spaced inlets 66 formed in the base plate that further connects into four finger-like internal cleaning agent flow passages 68, 70, 72, 74 that generally extend along the length thereof. The internal flow passages respectively terminate in laterally spaced discharge openings or nozzles 68', 70', 72', 74' at the outboard end of the base plate for discharging mixed streams of pressurized carbon dioxide gas and pellets and air onto the surfaces of the dies set for cleaning purposes. The cleaning head is closed by a bottom plate 76 secured to the base plate by suitable fasteners 78.

The elongated pellet conducting tube 48 of the end effector 40 transmits CO. pellets 50 from a pellet supply container 82 and connecting hose 83 into the head 62 of the end effector. The outboard end of the $CO_2$ pellet conducting tube 48 operatively connects onto the head 62 by four pellet feeding tubes 84, 86, 88 and 90 that operatively connect to fittings 92 of a connector block 94 mounted on the head 62 and then through vertical passages in a portion of the base plate 65 of the cleaning head and respectively into corresponding flow restricting or venturi sections 96 of the cleaning agent passages 68, 70, 72, 74.

With high velocity air being fed into the cleaning head 62 from a pressure source 94, a low pressure occurs in the restricted section of passages so that pellets 50 of dry ice will be drawn therein and begin to sublime into carbon dioxide gas. This mixture of $CO_2$ gas and remaining $CO_2$ pellets plus air is forced in high pressure streams S from the discharge nozzles 68', 70', 72' and 74' for sweeping and cleaning the foreign matter here identified as accumulated lubricant 32 from the forming surfaces 31 of the die 14.

Figure 2:
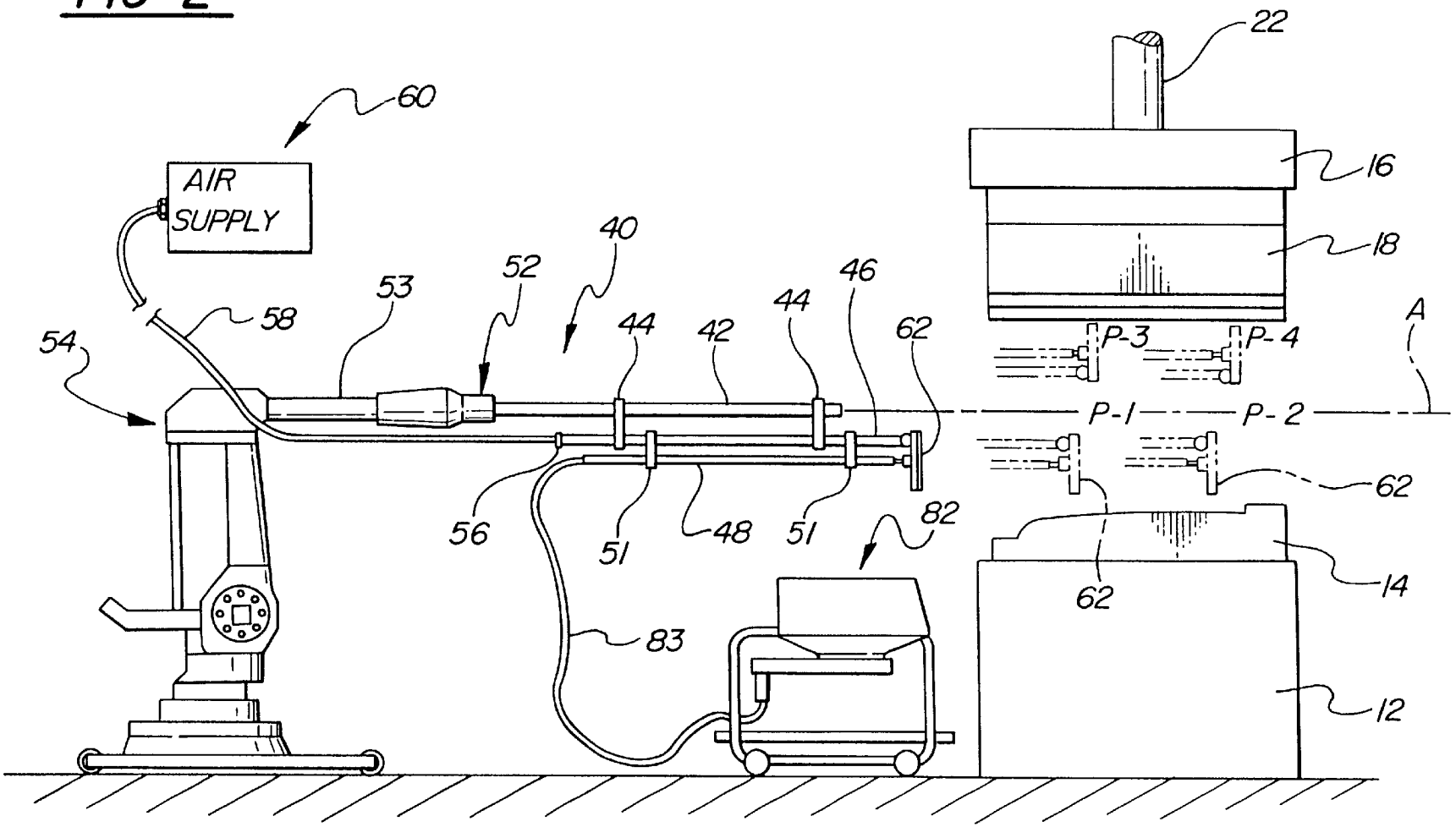
FIG. 2 is a diagrammatic side view of the robot and the attached cleaning unit of the present invention cleaning the profiled hot dies as operatively mounted in the forming press of FIG. 1.

FIG. 2 illustrates the end effector 40 being picked by the operating arm 53 of the robot 54 using the quick connect coupling 52 and moving the end effector into cleaning positions such as P1 through P4 between the forming die and upper tool chamber as maintained by the press such as during a cleaning operation and after a number of parts have been produced. Preferably, the robot is programmed to move the end effector in a sweeping manner such as diagrammatically illustrated. During such motions, the nozzle or discharge end of the cleaning head is maintained six to eight inches above the profiled surface of the forming dies 14. The same clearance is observed in cleaning the upper chamber if needed or an upper mounted forming die.

When the cleaning head of the end effector is in an initial position such as position P1, high-pressure air will then be supplied from the pressure sources and the associated hose into the air tube 46. Pressure air then feeds into the manifold 64. Streams of air then pass through the four laterally spaced inlet passages 66 in the base plate 65 of the cleaning head 62 and then into the corresponding four finger-like cleaning agent passages in the head and out of the nozzles. With low pressure areas provided by the venturi sections of these passages, dry ice pellets are forced from the supply unit 82 through hose 83 and into the pellet conducting tube 48. From the tube 48, the pellets of dry ice will be fed into the venturi sections where the solid pellets of carbon dioxide begin to sublime into carbon dioxide gas. This gas plus solid parts of pellets that have not yet sublimed mix with the air streams and are projected by the nozzles as pressure streams of cleaning agent onto the surface of the die. This cleaning agent flows across the surface of the die and sweeps away the build up of lubricants from previous forming of parts from the blank as well as any foreign matter falling or otherwise getting into the die.

With a mixture of air and carbon dioxide gas and remaining subliming pellets gas being used, a dry and substantially pollution-free cleaning agent is advantageously employed which cannot abrade or otherwise damage the hot forming surfaces of the dies. The remaining portions of the $CO_2$ pellets sublime during the cleaning operation. This invention accordingly simplifies production and effectively reduces or eliminates subsequent cleaning up of cleaning agent and attendant disposal problems, particularly since no liquids are involved.

In one preferred embodiment, the air supply pressure is in the range of 60 to 300 psi. The dry ice pellets are originally about ⅛ inch in length, and the distance from the nozzle tips to the die forming surface was in a range of 4 inches minimum to 8 inches maximum.

While some preferred methods and mechanisms have been disclosed to illustrate the invention, other methods and mechanisms embracing the invention can now be adapted by those skilled in the art. Accordingly, the scope of the invention is to be considered limited only by the following claims.

What is claimed is:

1. A method of superplastic and quick plastic forming sheet metal parts which are substantially free of show surface imperfection comprising the steps of heating a profiled metal forming die to a predetermined temperature range, inserting a sheet of lubricated metal stock onto the forming die, forcing the metal sheet onto the profile of the forming die to form a part, removing the formed part from the forming die, serially repeating the forming of parts until a number of parts have been produced, moving a die cleaning head in a predetermined pattern across the forming surface of the hot die, discharging mixed streams of carbon dioxide gas and solids and air onto the forming surface of the die while the head is moved in said pattern to physically force any build up of foreign matter including dry lubricant from the hot die surface while allowing the solid carbon dioxide gas to fully sublime, repeating the insertion sheet metal stock onto the cleaned forming die and forming additional parts free of deformation from lubricant build up on the forming surface thereof.

2. A method of cleaning heated superplastic and quick plastic forming dies after forming a plurality of sheet of metal stock each having a coating of dry lubricant thereon into substantially identical components having a show surface comprising the steps of: moving the cleaning head across the forming surface of an operationally hot forming die, discharging streams of carbon dioxide solid and gas mixed with streams of pressurized air onto the surface of said die to force the collected lubricant and other foreign matter from the forming surface of the forming die to thereby clean the die for subsequent continued operations to make additional parts without resulting surface flaws.

3. An end effector for cleaning the heated forming surfaces of a heated forming die set while operatively mounted in a press and moveable between opened and closed positions comprising an elongated support having a connector on one end thereof for operative connection with an actuator for moving the support relative to the dies in the press, an elongated air conducting tube secured to the support and co-extending therewith, an elongated tube extending alongside of said air conducting tube for conducting dry ice pellets therethrough, a head member operatively fixed to the end portions of said air and pellet conducting tubes to receive respective flows of air, said air tube and pellets from said pellet conducting tube, said head having a plurality of channels therein for direction sublimed pellets into a plurality of stream of gas and solid pellets directly onto the surface of said die that act on quantities of lubricant collected thereon and displacing said lubricant therefrom to thereby clean excess lubricants from said forming surfaces of said die set so that said die set can produce parts without lubricant accumulation defects.

4. An end effector for cleaning the heated forming surfaces of forming dies sets while operatively mounted in a press and moveable between opened and closed positions comprising an elongated support having a connector on one end thereof for operative connection with an actuator for moving the support relative to the dies in the press; and elongated dry ice pellet conducting tube extending alongside of said air conducting tube, a head member operatively fixed to the end portions of said air and pellet conducting tubes to receive respective flows of air, said air tube and dry ice pellets from said pellet conducting tube, said head having a plurality of channels therein for directing sublimed pellets into a plurality of stream of gas directly onto the surface of said die that act on quantities of lubricant collected thereon and displacing said lubricant therefrom to thereby clean excess lubricants from said forming surfaces of said die set so that said die set can produce parts without lubricant accumulation defects.

* * * * *